United States Patent [19]

Murphy

[11] 4,106,138

[45] Aug. 15, 1978

[54] PLATFORM BED

[75] Inventor: Timothy P. Murphy, Chatham, N.J.

[73] Assignee: Simmons Company, Atlanta, Ga.

[21] Appl. No.: 837,392

[22] Filed: Sep. 28, 1977

[51] Int. Cl.[2] ..... A47B 22/00; A47C 17/86

[52] U.S. Cl. ..... 5/181; 5/184; 5/352; 5/370

[58] Field of Search ..... 5/12 R, 181, 184, 329, 5/352, 357, 370, 371

[56] References Cited

U.S. PATENT DOCUMENTS

| | | | |
|---|---|---|---|
| 3,327,328 | 6/1967 | Slivoski | 5/181 |
| 3,363,270 | 1/1968 | McClive | 5/355 |
| 3,430,274 | 3/1969 | Ikeda | 5/184 |
| 3,711,875 | 1/1973 | Cox | 5/2 R |

*Primary Examiner*—Casmir A. Nunberg
*Attorney, Agent, or Firm*—Fitch, Even, Tabin & Luedeka

[57] ABSTRACT

A bed platform which incorporates a resilient mattress foundation by flanking the same with a sectional bolster structure.

5 Claims, 4 Drawing Figures

PLATFORM BED

This invention relates to beds, and, more particularly, to an arrangement for adapting a resilient mattress foundation for service in or as a platform bed.

Trends in furniture styling have recently emphasized a form of bed popularly referred to as a platform bed, i.e., one in which a bedstead in the traditional sense is not in evidence, and in which the bed appears essentially as a self-supporting platform rising from the floor. In some cases, the desired styling effect is achieved by actually placing a mattress upon a rigid platform, which may simply be a box or a box-like base with an overhung mattress-supporting slab, depending upon the styling effects sought by the designer. In the rigid platform, however, the desired design result is achieved at the expense of comfort, inasmuch as a majority of mattresses depend in part for their satisfactory performance upon the resilient foundations with which they are usually paired for sale.

It is the object of the present invention to achieve the platform effect from a styling standpoint without sacrificing the comfort of the bed. This result is accomplished by preserving the resilient mattress foundation intact for its customary mattress-supporting function, but providing with it, in easily-assembled relation, a surrounding sectional bolster structure which, together with the mattress foundation, provides an extended platform effect, but can be readily disassembled from the foundation, and the bolster sections from each other, for ease of shipment.

The invention, simple in nature, will be readily understood from the following detailed description made in reference to the accompanying drawings, in which.

Figure 1:
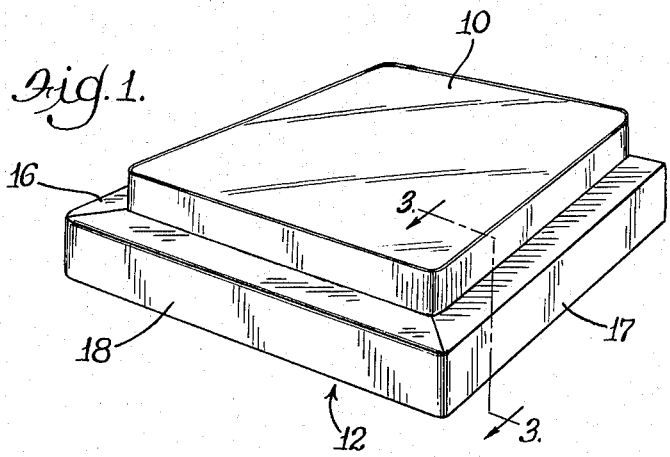
FIG. 1 is a perspective view of a platform bed in accordance with the invention, i.e., one in which the platform which supports the mattress is extended sidewardly and endwise from the foot of the bed by the assembly of bolster sections with the mattress foundation.
Figure 3:
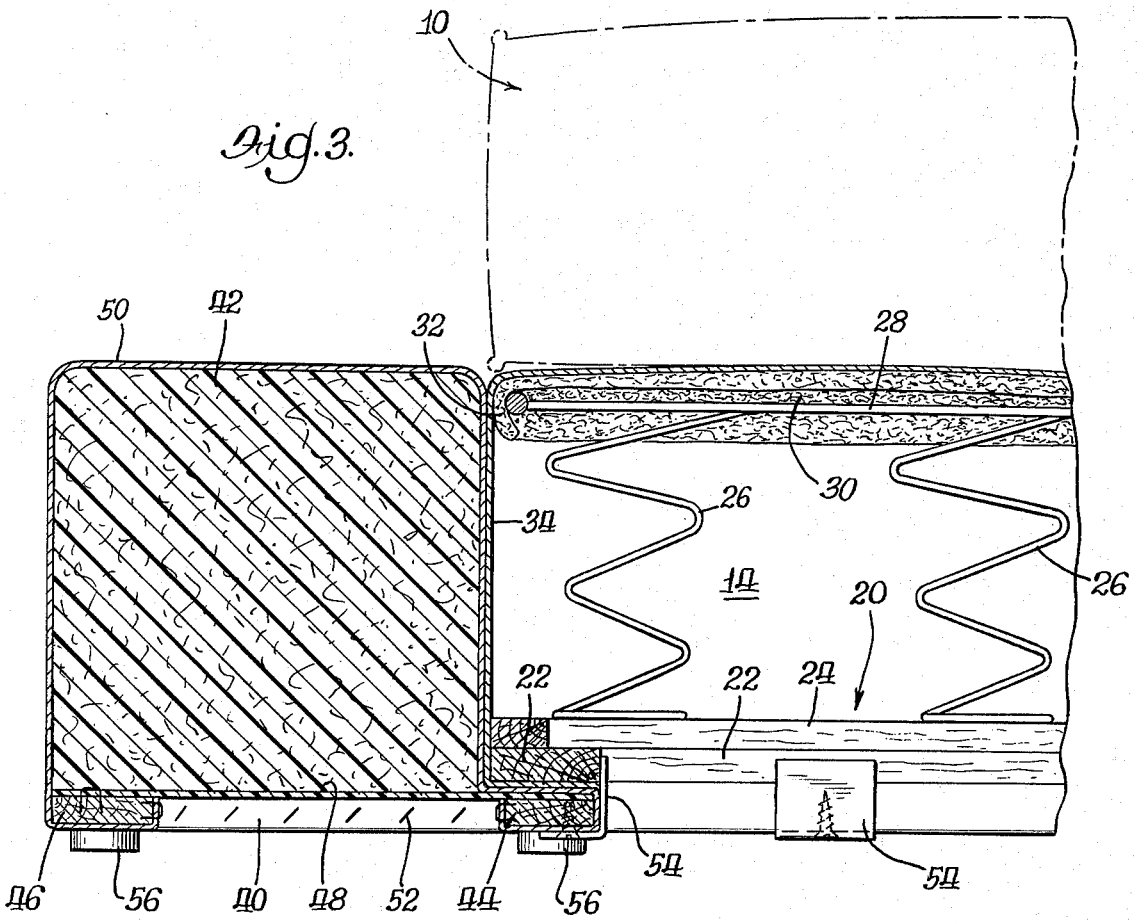
Figure 4:
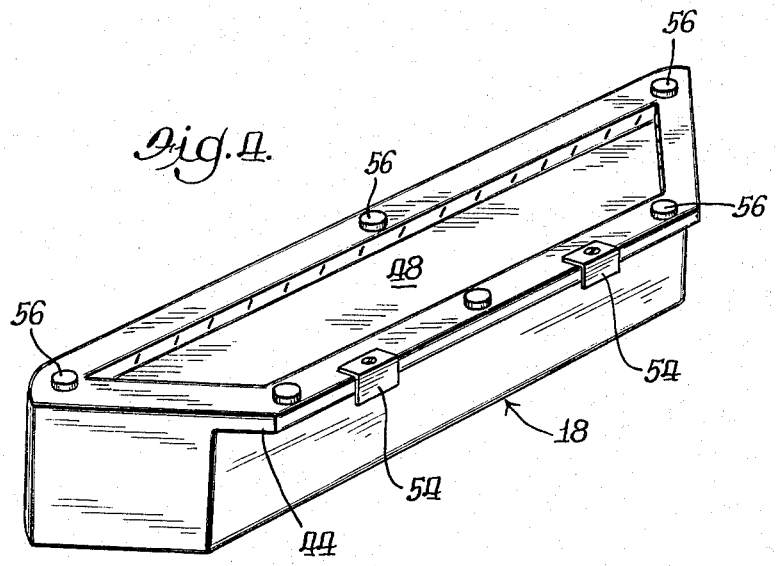

FIG. 3 is a fragmentary sectional view taken on the plane 3—3 of FIG. 1, i.e., a vertical section looking toward the foot end of the platform and showing in some detail the construction of the bolster sections and the mode of their assembly with the mattress foundation to form the "platform"; and FIG. 4 is a perspective view of the end bolster upended and seen from the bottom to better illustrate the mode of construction of the illustrated preferred form.

A platform bed utilizing the invention is one in which the mattress 10, which may be of any size and any interior construction, is supported upon a platform 12 comprising a resilient foundation 14 (obscured in FIG. 1), flanked on both sides by bolster sections 16 and 17, and by end bolsters 18 and 19, one or both, which extend the surface of the resilient foundation 14 to constitute the larger platform 12.

As used in this connection, the term "mattress foundation" is intended to mean any resilient support for a mattress irrespective of the kinds of springs or spring equivalents which may be mounted upon a relatively rigid base frame to provide the resilient support. The base frames for such units, if upholstered, are quite commonly made of wood, or include wood, often to the extent of having a wooden peripheral frame which is surmounted by multiple cross slats, of wood or other material, to carry the spring units which support the yielding upper surface of the foundation. Such springs if upholstered and provided with an outer textile cover, are commonly also called "box springs", but the term "box spring", when used herein, is intended in a broader, more encompassing sense to include any kind of resilient mattress foundation which includes a substantially rigid base frame.

The particular mattress foundation or "box spring" 14 illustrated in the drawings (FIGS. 2 and 3) is one of several more or less conventional box springs, as that term is now understood in the bedding industry, i.e., a wooden base frame 20 comprising a peripheral frame 22 surmounted by multiple cross-slats 24 supporting a multiplicity of cone coil wire springs 26 which are secured to the cross-slats 24 and connected together at their tops in or by some sort of wire fabric 28 which supports a layer of insulation 30 and perhaps an additional layer of softer padding 32 before the application of pre-sewed upholstery cover 34, the border of which is stapled or otherwise secured to the underside of the periphery of the wooden base frame 20. It may also have a bottom "dust cover", not shown, of thin sheet such as dark scrim or perforated opaque plastic film.

Figure 2:
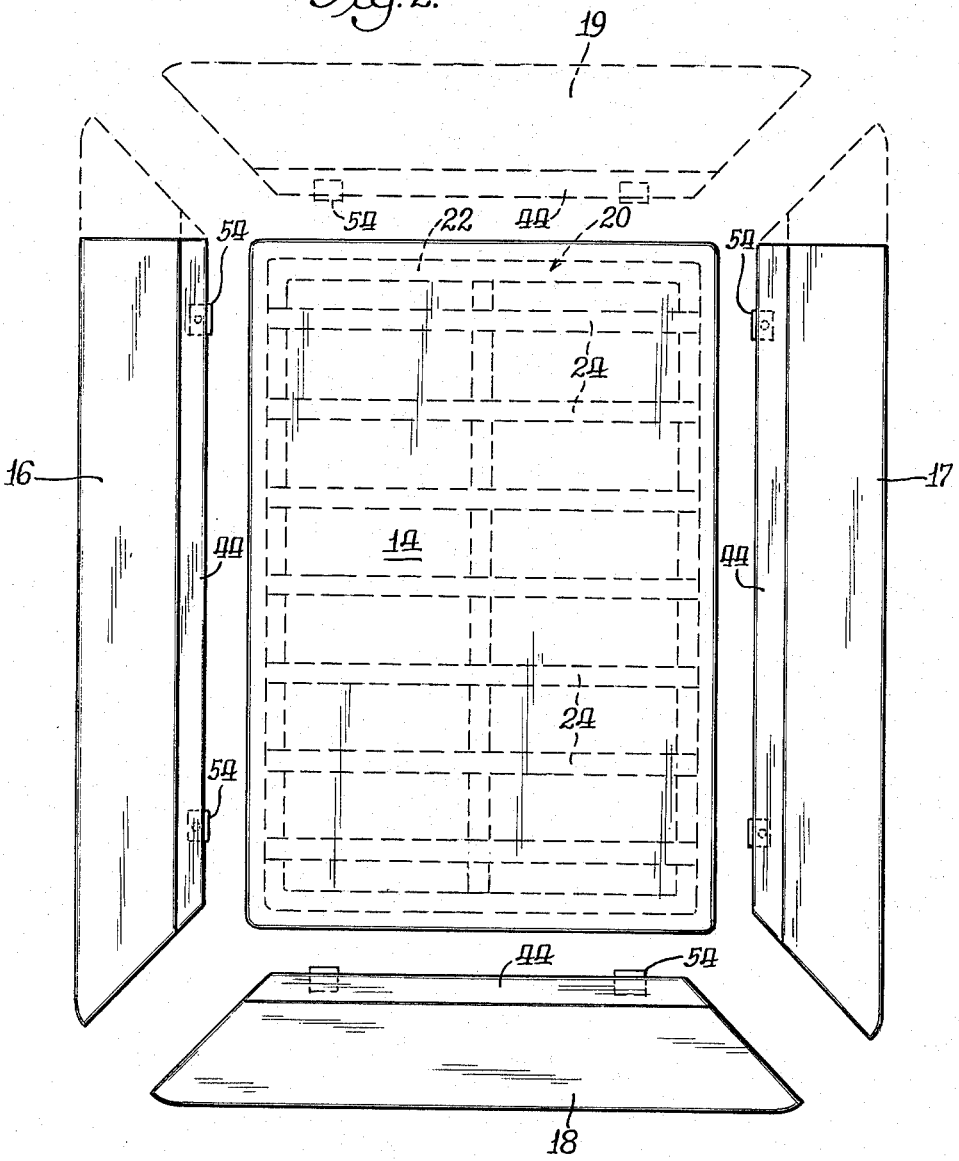
FIG. 2 is a plan view of the same with the mattress removed and with the several bolster sections separated from the box spring to indicate the manner in which the platform is assembled and disassembled, and, indeed, in which the individual parts may be isolated for packaging and shipment.

As indicated by FIGS. 2 and 3, the box spring 14 is surrounded by a sectional bolster, each section of which comprises a base frame 40 and an upper body portion 42 which is less than coextensive with the base frame so as to provide along one of its long edges a ledge 44 which extends beneath and provides support for the adjacent edge of the box spring.

In the illustrated form, each bolster section comprises a peripheral frame 46 of the desired outline fabricated from standard lumber, e.g., 1 × 3's which are covered on one side by a conforming sheet 48 of rigid board, such as hard fiberboard, stapled and glued to the frame 46. Mounted on top of the base frame, and cemented to the upper surface of the rigid sheet 48 is a cushion block of resilient material, such as foamed polyurethane, which comprises the body portion 42, all exposed surfaces of the bolster being enclosed by an upholstery cover 50 which may be any kind of decorative flexible sheeting. The cover 50 may be totally or partially adhered to the cushion block, and drawn taut and tacked off to the inside edges of the base frame 46, as indicated in FIG. 3 at 52.

As also indicated in FIG. 3, the ledge 44 of the base frame of the bolster section 17 is approximately coextensive with the overlying slat or board of the peripheral frame 22 of the box spring. While it is preferred that the upholstery cover 50 of the bolster extend around and cover the ledge 44 of the base frame of the bolster, and anticipated that the contacting upholstery cover of the box spring would be in direct contact with the upholstery cover of the bolster ledge and provide some frictional resistance to separation, it is thought advisable also to provide one or more upstanding retainer tabs 54 at the edge of the ledge 44 of a height sufficient to engage the inside edge of the peripheral frame 22 of the foundation 14 to resist any lateral pull tending to separate the bolster from the foundation. The retainer tab 54 is conveniently made in the form of a metal angle clip, one leg of which is secured to the underside of the ledge portion 44 of the base frame so that the complementary leg extends upwardly vertically at the edge of the ledge portion of the bolster section. As it will usually be desired to provide glides 56 on the undersurface of the bolster sections, the retainer tabs 54 are simply screwed to that portion of the bolster frame without being set into the frame, a procedure which may recommend itself if glides are omitted.

Referring still to FIG. 3, it will be seen that the cushion block selected for the body portion 42 of the bolster section in the illustrated case rises to the full height of the foundation 14 when assembled with the bolster, so as to provide, in effect, an extension of the upper surface of the box spring. It is also contemplated that the bolster may be higher than the foundation when assembled with it, as may be desired to give a thinner profile to the mattress on the foundation. Also, while the bolster is shown as rectangular in cross-section, it may assume other cross-sections, e.g., triangular or curvilinear, without departing from its function of providing a visual extension of the foundation. It will be appreciated, moreover, that if full-depth cushioning of the bolster sections is neither required nor desired, the body portion of the bolster may take some other form, e.g., a box which, however, is preferably upholstered at least to some degree for styling and comfort reasons.

The construction of the bolster is such as to accommodate its disassembly from the box spring for shipping purposes, and the ready reassembly of the constituent parts into a cooperating whole. For this purpose, as indicated by the drawings, the bolster structure is made in sections. Where a completely surrounding bolster is desired for an island form of bed, a bolster section is provided for each side of the foundation and one for each end, as indicated in FIG. 2 by the additional broken line representations of a head-end bolster section 19 and symmetrical, cornering end portions on the side sections 16 and 17. In more conventional applications, i.e., those in which the head of the bed is placed in proximity to a wall, no bolster section is provided at the head of the bed, and the side bolster sections are squared off at the head-end of the bed so as to be coextensive with the mattress foundation, as indicated by the solid line showing of FIG. 2. However, the encircling effect of the bolster sections in either case is preferably achieved by mitering the adjoining ends of the end and side bolster sections, which also serves to provide a convenient centering or positioning effect when assembling the bolster sections with the box spring.

It will be appreciated that many variations of form and construction follow from the foregoing disclosure. Basically, however, the structure of the invention seeks to utilize the mattress foundation as an anchor for the flanking bolster sections in such a way that the interengagement of the underside of the foundation with the underlying portions of the bolster sections tends to prevent parting of the two members without first lifting the box spring.

The disclosed arrangement brings to the platform bed the sleeping comfort attainable in the conventional bed consisting of mattress and underlying resilient foundation while giving the designer a new styling latitude.

The features of the invention believed new and patentable are set forth in the following claims.

What is claimed is:

1. A bed platform for supporting a mattress, comprising a resilient mattress foundation and a sectional bolster structure flanking the foundation in abutting relation, each bolster section having a flat base to support the same upon the floor and a body portion rising from the base alongside the foundation, said base extending sidewardly from said body portion to underlie the adjacent edge of the base frame of the foundation, said foundation resting upon the base extensions of said bolster sections to maintain the assembly of said sections therewith.

2. The bed platform of claim 1, in which the base extensions of the bolster sections are provided with means to interlock the bolster sections with the base frame of the foundation against parting lateral movement away from the foundation.

3. The bed platform of claim 1 in which the base extensions of the bolster sections are at least as wide as the peripheral framing of the foundation and provided at their edges with an upwardly extending tab to engage the inner edge of said peripheral framing to prevent disengagement of the bolster section from the foundation by direction lateral movement.

4. The bed platform of claim 1 in which the sectional bolster flanks the foundation on two sides and at least one end, and in which the sections thereof are coextensive with said sides and end and meet in an abutting mitered fit at the corners of the platform at said end.

5. A sectional bolster structure for assembly with a resilient mattress foundation to form a platform bed for supporting a mattress, comprising a plurality of bolster sections each having a substantially flat base to support the section upon the floor and a body portion rising above the base, said base portion extending sidewardly from said body portion along one long edge thereof as a ledge for supporting the adjacent edge of the foundation with which the same is to be assembled, said ledge being substantially as wide as the overlying peripheral frame member of the foundation and having means engaging said frame member to prevent lateral separation of the bolster section from the foundation without lifting the latter, said plurality of sections including at least one section for each side edge and one end edge of the foundation.

* * * * *